US009101172B2

(12) United States Patent
Mycoskie

(10) Patent No.: US 9,101,172 B2
(45) Date of Patent: Aug. 11, 2015

(54) WRAP BOOT FOR A WEARER'S FOOT

(75) Inventor: Blake Mycoskie, Marina Del Rey, CA (US)

(73) Assignee: Mycoskie, LLC, Austin, TX (US)

( * ) Notice: Subject to any disclaimer, the term of this patent is extended or adjusted under 35 U.S.C. 154(b) by 1788 days.

(21) Appl. No.: 12/355,315

(22) Filed: Jan. 16, 2009

(65) Prior Publication Data

US 2009/0183394 A1 Jul. 23, 2009

Related U.S. Application Data

(60) Provisional application No. 61/021,837, filed on Jan. 17, 2008.

(51) Int. Cl.

| | |
|---|---|
| ***A41D 17/02*** | (2006.01) |
| ***A41D 17/04*** | (2006.01) |
| ***A43B 3/16*** | (2006.01) |
| ***A43B 1/00*** | (2006.01) |
| ***A43C 11/14*** | (2006.01) |

(52) U.S. Cl.

CPC ..... *A41D 17/04* (2013.01); *A43B 1/0081* (2013.01); *A43B 3/16* (2013.01); *A43C 11/1493* (2013.01)

(58) Field of Classification Search

CPC ..... A43B 1/0081; A43B 3/00; A43B 3/16; A43C 11/1493; A43C 11/146; A43C 11/00; A04D 17/00; A04D 17/005; A04D 17/02; A04D 17/041

USPC ..... 36/2 A, 2 R, 136, 132, 83; 2/242

See application file for complete search history.

(56) References Cited

U.S. PATENT DOCUMENTS

| | | | | | |
|---|---|---|---|---|---|
| 1,399,929 | A | * | 12/1921 | Chamberlin | 36/2 R |
| 1,705,782 | A | * | 3/1929 | Powers | 36/2 A |
| 1,916,036 | A | * | 6/1933 | Boreham | 36/2 A |
| 3,083,373 | A | * | 4/1963 | Rizzotto | 2/270 |
| 4,896,437 | A | * | 1/1990 | Johnson | 36/1.5 |
| 5,642,573 | A | | 7/1997 | Brown | |
| 6,131,194 | A | * | 10/2000 | Ardura Gonzalez | 2/22 |
| 6,477,788 | B1 | * | 11/2002 | Chen | 36/1.5 |

FOREIGN PATENT DOCUMENTS

| | | |
|---|---|---|
| EP | 281409 | 9/1998 |
| KR | 20-1999-0016166 | 5/1999 |
| KR | 20-0281382 | 7/2002 |
| WO | WO-2009-091975 | 7/2009 |

OTHER PUBLICATIONS

International Search Report issued in PCT/US2009/031246, mailed Jun. 2, 2009.

Written Opinion issued in PCT/US2009/031246, mailed Jun. 2, 2009.

"Marios" women's sneakers, www.yoox.com, retrieved on Sep. 25, 2008.

* cited by examiner

*Primary Examiner* — Jila M Mohandesi

(74) *Attorney, Agent, or Firm* — Taft Stettinius & Hollister, LLP; Anthony P. Filomena, III

(57) ABSTRACT

A wrap boot for a wearer's foot comprising a shoe member and a legging. In use, the legging is wrapped a plurality of times around the lower part of the wearer's leg. The wrap boot may be manufactured from any conventional materials and the legging may be permanently or detachably affixed to the shoe-member. The legging may comprise a fastening means to prevent the wrap boot from unraveling.

16 Claims, 3 Drawing Sheets

WRAP BOOT FOR A WEARER'S FOOT

This application claims the priority benefit of U.S. provisional patent application Ser. No. 61/021,837, filed on Jan. 17, 2008, the contents of which are incorporated herein in their entirety.

The present invention is directed to the field of footwear. Specifically, the invention is directed to a wrap boot for a wearer's foot.

BACKGROUND

A boot is a type of shoe that covers the foot and the ankle and sometimes extends up to the knee or even the hip. Most boots have a heel that is clearly distinguishable from the rest of the sole, even if the two are made of one piece. Traditionally, boots are made from leather or rubber, although modern boots are made from a variety of materials.

Many boots have side zippers or other means of opening and closing the leg portion to facilitate donning the boot. However, boots are typically designed in a single sized upper portion for a given shoe size, and the upper portion of a boot is generally not adjustable to the specific wearer's calf or leg. If a person's foot fits a particular boot, but the person's leg is too narrow or wide for the boot, that person will not purchase the boot and will look for another style or manufacturer.

In many instances, a boot may be form-fitting when the wearer is wearing particular clothing, but will not fit properly when the wearer is wearing other clothing. For example, if a person dons a boot while wearing nylons or stockings, the boot may fit well, but when the wearer dons the same boot wearing thick socks, the leg portion of the boot may be too tight. Alternatively, some boots allow the wearer's pants leg to fit inside the boot, while other boots fit tightly and do not allow for this.

Accordingly, there is a need for a boot which can be adjusted to a wearer's particular leg size.

Furthermore, although a boot can provide support to the ankle or lower leg, a boot having a leg portion with a fixed size is of limited utility unless the wearer happens to fit the pre-manufactured size. No matter how well the boot may fit the intended wearer, the leg portion of the boot must have a certain amount of give to permit the boot to be worn. Similarly, depending on varying stresses to which any given wearer may, over time, expose his or her lower extremities, there is a utility in being able to adjust the firmness and tension of the fit over time. For example, a boot having an adjustable fit has advantages in sports or other strenuous physical activities. Alternatively, such an adjustable-fit boot can be a fashionable article for wear.

Accordingly, there is a need for a boot that can be adjusted to the particular dimensions of a wearer's leg to provide maximal support.

BRIEF DESCRIPTION OF THE INVENTION

The present invention is a wrap boot which addresses the above issues associated with prior boots. One embodiment of a wrap boot according to the present invention comprises (a) a shoe member; and (b) a legging attached to the shoe member. The legging is structurally designed and configured to be wrapped around the lower leg of the wearer.

Advantageously, the inventive wrap boot can be worn wrapped over or under a wearer's clothing, depending upon the wearer's preference, and irrespective of the thickness or other dimensions of the clothing. The wrap boot fits snugly over or under clothing such as pants, socks, leggings, or clothing on the wearer's foot or leg. The wearer can adjust the tension provided by the legging to suit his or her personal preference. For example, one wearer may adjust the legging to provide a tighter wrapping around the leg, while another wearer may wish to have a looser wrapping around the leg.

For purposes of discussion, unless further qualified, the present invention will be referred to as a boot or a wrap boot. The wrap boot may also be identified as a shoe-boot.

The inventive boot can be worn in all weather conditions. For example, in cold weather, the wearer can choose to wear heavy socks under the boot to provide additional warmth, while in warm weather, the wearer may choose to wear sheer socks or stockings under the boot. The legging can be readily wrapped around the wearer's socks, stockings, or leg, and adjusted to the wearer's comfort. Such adjustments are not possible with prior boots. The wrap boot itself can be made with or without a lining or other insulating materials with any kind of dimensions.

DETAILED DESCRIPTION OF THE INVENTION

The shoe member of the inventive boot can be a standard shoe as is known in the art. For example, the shoe member can comprise a sole and an upper. The shoe member may be open-toe or closed-toe. The shoe member can be configured as a slip-on shoe, laced shoe, capped-toe shoe, sandal, athletic shoe, slipper, espadrille, or any other kind of shoe. The shoe member can have a heel giving height to the wearer, or the shoe member can be a "flat" shoe without a heel. The sole can have treads or markings, such as the manufacturer's logo impressed into the sole. FIGS. 1-4 illustrate one embodiment of a shoe member of the inventive wrap boot.

The legging of the inventive boot may be detachable or non-detachable from the shoe member. In one embodiment, the manufacturer can sell the wrap boot as a convertible boot. In such an embodiment, the shoe member and legging are provided as separate elements which can be packaged together in a kit or sold separately. In this embodiment, the shoe member can be worn as a regular shoe without a legging. The wearer can convert the shoe member into a wrap boot by attaching the legging to the shoe using a provided fastener such as a hook-and-loop fastener, Velcro®, a snap, a hook-and-eye attachment, or any other kind of attachment means. In this manner, a customer can purchase a single article of footwear which can be worn as a shoe or as a boot.

In other embodiments of the invention, the legging is not detachable from the shoe member. In such instances, the legging can be sewn, glued, stapled, or otherwise permanently affixed to the shoe member and cannot be removed from the shoe member without causing damage to the boot.

Figure 1:
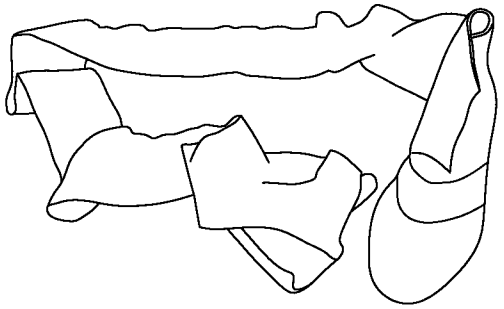
FIG. 1 illustrates a front view of the shoe member of an embodiment of the inventive wrap boot in which the legging of the wrap boot is loosely arranged around the shoe member.
Figure 2:
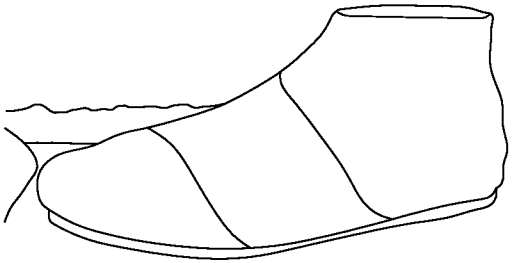
FIG. 2 illustrates a left side view of the shoe member of the wrap boot shown in FIG. 1.
Figure 3:
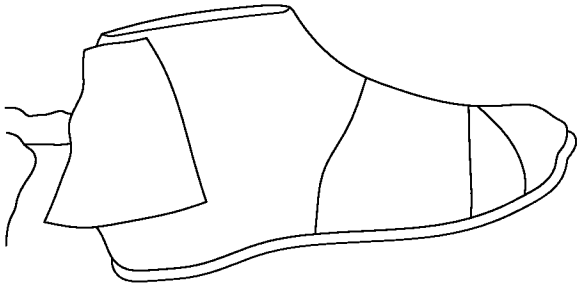
FIG. 3 illustrates a right side view of the shoe member of the wrap boot illustrated in FIG. 1.
Figure 4:
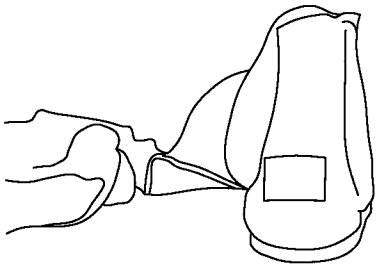
FIG. 4 illustrates a rear view of the shoe member of the wrap boot illustrated in FIG. 1.
Figure 6:
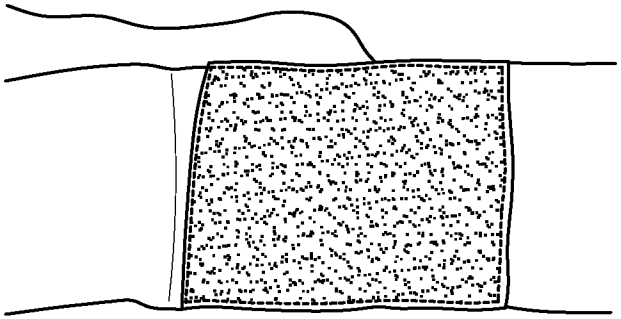
FIG. 6 illustrates another portion of the legging of the wrap boot of FIG. 5, in which the hook portion of the hook-and-loop fastener has been affixed to the legging.
Figure 5:
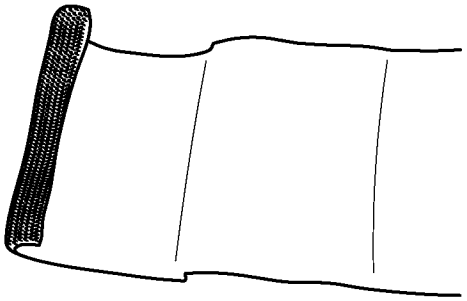
FIG. 5 illustrates an end portion of the legging of the wrap boot of FIG. 1, in which the loop portion of a hook-and-loop fastener has affixed to the end of the legging.
Figure 8:
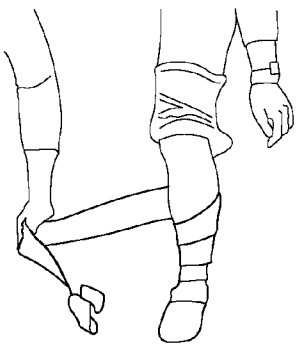
FIG. 8 illustrates the embodiment of FIGS. 1-6, in which the wearer is in the process of wrapping the legging around the lower leg.
Figure 10:
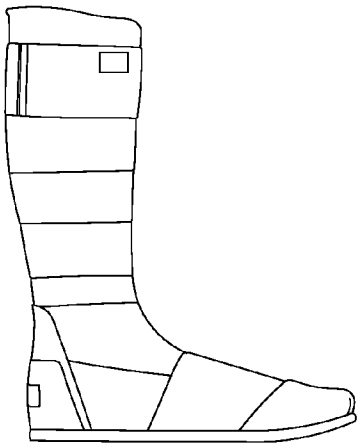
FIG. 10 is a drawing of a second embodiment of the inventive wrap boot in the fully-wrapped state.
Figure 7:
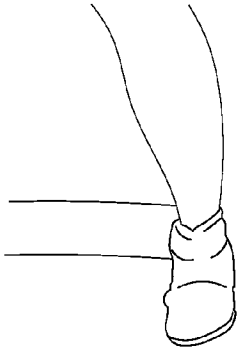
FIG. 7 illustrates the embodiment of the wrap boot of FIGS. 1-6 in which a wearer has donned the shoe member and prior to wrapping the legging around the leg.
Figure 9:
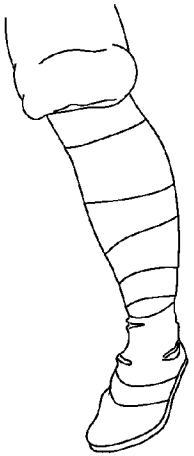
FIG. 9 illustrates the embodiment of FIGS. 1-6, in which the wearer has finished wrapping the legging around the lower leg and calf.

FIGS. 5 and 6 illustrate an embodiment of a legging permanently affixed to the shoe member. The legging has a hook-and-loop fastener for securing the legging in position after it has been wrapped around the wearer's leg. To don the boot, the wearer would first place his or her foot into the shoe member (FIG. 7). The wearer would then wrap the legging around his or her leg (FIG. 8). After the legging has been completely wrapped around the leg, the legging would then be fastened in place to prevent the boot from unwrapping during wear (FIGS. 9 and 10).

The boot may be formed of any convenient or conventional materials. For example, the shoe member, the legging, or both, may be formed from a natural substance, a synthetic substance, or a combination of both. In one example, the shoe member may be formed from canvas, and the legging may be formed from a synthetic fiber such as nylon. In other embodiments, the wrap boot or its various components can be manufactured from leather, pleather (artificial leather), canvas, suede, fabric, rubber, or from combinations of any of these or other materials without limitation. The wrap boot can be manufactured from any convention or atypical materials of construction known in the art.

The wrap boot or a portion thereof can also be formed from an elastic material. For example, the shoe member and the legging can be formed from stretchy canvas. The various components of the wrap boot can be manufactured from the same or from different materials.

The wrap boot itself can be made with or without a lining or other insulating materials of any number of varying dimensions or materials.

The legging is structurally designed and configured to be wrapped around the calf, ankle, lower leg, and/or thigh of the wearer. For example, the legging can be wrapped or wound a plurality of times around the lower leg, ankle and calf of the wearer. Alternatively, the legging can be wrapped or wound around once. The number of times that the legging can be wrapped around the wearer's leg will depend upon the length and width of the legging. A longer legging will wrap around the wearer's leg more times than will a shorter legging.

In particular embodiments, the boot can provide support for a wearer's leg, similar to compression stockings. For example, the wrap boot can be useful for wearers with sensitive or swollen legs, large or heavy calves, circulation problems, injury to the ankle, lower leg muscle or other connective tissue, diabetes, neuropathy, cold feet, or chronic tired legs from standing all day. In such instances, the wrap boot can provide support, warmth, and improve the wearer's circulation, thereby increasing comfort. The legging can enhance circulation by exerting the greatest pressure at the wearer's ankles, which then decreases gradually up the leg. In this manner, the wrap boot can comfortably support the venous and lymphatic systems of the wearer's legs and help reduce leg fatigue, aching feet, swollen ankles and the discomfort caused by varicose veins. This compression, when combined with the muscle pump effect of the calf, aids in circulating blood and lymph fluid through the legs.

The legging can be wound as tightly or loosely around the wearer's legs as desired or as directed by a doctor or medical practitioner. Conditions which can be treated in this manner include tired, aching legs, varicose veins, venous insufficiency, edema (swelling), lymphedema, burn scars, and management of active venous ulceration. The wrap boot may also be used to prevent deep vein thrombosis, or for use after vein surgery, sclerotherapy, and other conditions.

Depending upon personal preference and style, the legging may be conveniently wrapped over a wearer's pants' leg. Alternatively, the legging may be wrapped directly over a wearer's calf, or over socks, nylons, stockings, or similar garments. In such instances, the wearer can place his or her pants or trousers cuff over the boot. The wearer may also choose to wrap the legging over his or her pants.

The legging may comprise a fastening means to prevent unwrapping of the legging during wear. The fastening means can be any closure mechanism known in the art to mechanically join or affix two or more objects together. For example, the fastening means can be a snap closure, hook and eye fastener, hook and loop fastener, Velcro® fastener, button, clasp, clip, pin, grommet, or other fastener without limitation. Such fastening means can also be made to provide a water-tight or water resistant seal.

The fastening means can be located at any position on the legging. In one embodiment, the fastening means is located at the top end of the legging, and the wearer would clip, snap, or otherwise fasten the end of the legging to a mating fastener located in a suitable position along the legging. Alternatively, the fastening means can be located along the perimeter or length of the legging. For example, the edges of the legging may have a Velcro® band, and as the legging is wrapped upwards around the wearer's foot, corresponding Velcro® surfaces mate, thereby securely fastening the legging around the foot and thereby preventing unwrapping of the legging. The fastening means or fastener can also be provided as a separate element upon delivery of the boot so that the wearer can position the fastener in the desired position. The fastener can be provided as a repositionable element or at a fixed location on the legging.

The legging can be affixed to the shoe member as a fixed length element. Alternatively, the length of the legging can be made to be adjustable by the wearer. For example, the legging may have a buckle, elastic band, or some other kind of other adjustable element along its length, thereby permitting wearers to adjust the length or elasticity of the legging, or the tightness of its wrapping, to particularly suit their personal preference.

The legging can also be provided as a fixed length to be trimmed by the wearer to a desired length. In such embodiments, the legging can be in the form of a long element, and the wearer can physically cut the legging with scissors or another tool to the designed length. For example, if the legging is a 5 foot long element having Velcro® fasteners every 6 inches along its length, the wearer can trim the legging to be 4.5 feet long, 4 feet long, 3.5 feet long, and so forth. Wearers wishing a small amount of leg coverage can trim the legging to be 3 feet long, for example, while wearers wishing a higher amount of leg coverage can keep the legging's original 5 foot length. In this embodiment, the fastening means can be affixed to the legging by the manufacturer, or the wearer can affix the fastening means at a desired location just prior to wear.

In one embodiment, the legging is in the form of a wide strap. The legging can have any convenient width. The wearer will generally wrap the legging more times around the leg for a narrower legging than for a wider legging to obtain a given amount of leg coverage. In one embodiment, the width of the legging is in the range of from about 0.5 inches to about 5 inches. In alternative embodiments, the legging is outside of this range. The width of the legging can be consistent throughout its length, or the width can vary. For example, the width of the legging can vary from 4 inches near the foot to 2 inches at the top of the boot.

The length of the legging will vary according to personal taste or the manufacturer's design. In one embodiment, the length of the legging is in the range of from about 1 foot to about 3 feet. In other embodiments, the length of the legging is outside of this range. The legging may be short and wraps around just the ankle and lower leg of the wearer (ankle-height), or it may be longer to wrap around the wearer's calf above or below the knee (knee-height). The legging may also be sufficiently long to wrap the wearer's thigh (thigh-height).

The legging or the shoe member may optionally comprise an insulating material against cold or water. For example, the legging may have a wool or Thinsulate® inner lining to provide warmth during cold weather. The legging may also have rubber or plastic component, such as an outer lining, to prevent water or dampness from reaching the wearer's skin. The insulating material may be provided as a removable or non-removable layer, or incorporates as an integral part of the legging.

The wrap boot can have any particular color or pattern, or it may be multicolored. The manufacturer may place a logo or mark at any particular position on the boot, such as at the top of the boot or on the heel.

The wrap boot may have particularly useful applications in heavy industries or in combat situations. For example, the wrap boot may be particularly suitable in industries in which the lower leg is subject to significant stresses such as mining or the military. In such instances, the shoe member can be fitted with a steel toe, and the wrap boot may have stiffening components or fabrics to provide protection to the foot and lower leg. Other uses and embodiments will be evident to those of skill in the art.

While the invention has been particularly shown and described with reference to particular embodiments, those skilled in the art will understand that various changes in form and details may be made without departing from the spirit and scope of the invention.

What is claimed is:

1. A boot for a wearer's foot, the boot comprising: (a) a shoe member; and (b) a legging attached to the shoe member, the legging structurally designed and configured to be wrapped around the lower leg of the wearer, wherein the legging is not detachable from the shoe member.

2. The boot according to claim 1, wherein the shoe member comprises a sole and an upper.

3. The boot according to claim 1, wherein the shoe member, the legging, or both, are formed from a natural substance, a synthetic substance, or a combination of both.

4. The boot according to claim 1, wherein the shoe member, the legging, or both, are formed from leather, canvas, suede, fabric, rubber, or combinations thereof.

5. The boot according to claim 1, wherein the shoe member, the legging, or both, are formed from an elastic material.

6. The boot according to claim 1, wherein the legging is structurally designed and configured to be wrapped a plurality of times around the lower leg and calf of the wearer.

7. The boot according to claim 1, wherein the shoe member is a slip-on shoe, laced shoe, capped-toe shoe, sandal, athletic shoe, slipper, or espadrille.

8. The boot according to claim 1, wherein the boot provides support for a wearer's leg.

9. The boot according to claim 1, wherein the legging is wrapped over or under a wearer's clothing during wear.

10. The boot according to claim 1, wherein the legging comprises a fastening means to prevent unwrapping of the legging during wear.

11. The boot according to claim 10, wherein the fastening means is a snap closure, hook and eye fastener, hook and loop fastener, button, clasp, clip, pin, or a grommet.

12. The boot according to claim 1, wherein the length of the legging is adjustable by the wearer.

13. The boot according to claim 1, wherein the legging is in the form of a wide strap.

14. The boot according to claim 1, wherein the width of the legging is in the range of from about 0.5 inches to about 5 inches.

15. The boot according to claim 1, wherein the length of the legging is in the range of from about 1 foot to about 3 feet.

16. The boot according to claim 1, wherein the legging contains an insulating material against cold or water.

* * * * *